United States Patent [19]

Gabriel et al.

[11] Patent Number: 4,877,544

[45] Date of Patent: Oct. 31, 1989

[54] OXIDATION STABLE SURFACTANTS

[75] Inventors: Robert Gabriel, Maplewood, N.J.; Michael P. Aronson, West Nyack, N.Y.; Peter L. Steyn, West Caldwell, N.J.

[73] Assignee: Lever Brothers Company, New York, N.Y.

[21] Appl. No.: 183,512

[22] Filed: Apr. 14, 1988

Related U.S. Application Data

[63] Continuation-in-part of Ser. No. 40,386, Apr. 17, 1987, abandoned.

[51] Int. Cl.[4] ..... C11D 1/722; C11D 3/395

[52] U.S. Cl. ..... 252/99; 252/135; 252/174.21; 252/174.22; 252/186.43; 252/187.26; 252/187.34; 252/DIG. 1; 252/DIG. 14; 568/608

[58] Field of Search ..... 252/174.22, 174.21, 252/DIG. 1, 135, 99; 568/608

[56] References Cited

U.S. PATENT DOCUMENTS

| | | | |
|---|---|---|---|
| 3,941,710 | 3/1976 | Gilbert | 252/99 |
| 4,146,736 | 3/1979 | Scheffel | 568/607 |
| 4,587,365 | 5/1986 | Anchor | 568/619 |

FOREIGN PATENT DOCUMENTS

| | | |
|---|---|---|
| 2214974 | 10/1973 | Fed. Rep. of Germany . |
| 1169496 | 11/1969 | United Kingdom . |
| 2164350 | 3/1986 | United Kingdom . |

*Primary Examiner*—Paul Lieberman
*Assistant Examiner*—Kathleen Markowski
*Attorney, Agent, or Firm*—Milton L. Honig

[57] ABSTRACT

The invention concerns detergent compositions comprising a special type of oxidation resistant nonionic surfactant and an oxidizing agent which may either be a hypochlorite or a peroxygen material. The surfactant component structurally comprises a $C_8$–$C_{12}$ alkyl substituted phenoxy hydrophobe alkoxylated with ethylene oxide and/or propylene oxide, with the proviso that the ratio of ethylene oxide to propylene oxide is at least 1 but no higher than 10. Methyl or chloroethyl groups are used to endcap the surfactant.

18 Claims, No Drawings

OXIDATION STABLE SURFACTANTS

This is a continuation-in-part application of Ser. No. 040,386 filed Apr. 17, 1987 now abandoned.

BACKGROUND OF THE INVENTION

1. Field of the Invention

The invention relates to the new surfactants and detergent compositions containing these new surfactants in combination with oxidizing agents.

2. The Prior Art

Certain types of cleaning compositions, such as automatic dishwashing detergents, demand the presence of oxidizing agents to operate effectively. Hypochlorite generating compounds are most commonly employed as the oxidizing agent. Although less economical, peroxygen compounds such as sodium perborate have also been reported as useful.

While the present invention has application beyond automatic dishwashing detergent compositions, it is these type compositions which are of particular commercial concern. Therefore, it is appropriate that the problems associated with automatic dishwashing be here set forth.

Automatic dishwashing detergent compositions employ alkaline salts such as sodium silicate, sodium carbonate and sodium tripolyphosphate as the main cleaning agents. A hypochlorite source is included in the formulation mainly for the purpose of breaking up protein soil. Once solubilized, protein soil, derived from foods such as eggs and milk products, gives rise to foaming problems. Foam generation, in turn, interferes with the cleaning action of the machine dishwasher. Without effective foam suppression, the mechanical cleaning action of the dishwasher is reduced because foam build-up partially insulates tableware from the full force of the aqueous washing composition.

Small amounts of nonionic surfactants are usually added to dishwashing compositions to combat the foam problem. Glassware appearance is, to an extent, also improved by the presence of the surfactant. Indeed, spotting and filming is particularly sensitive criterion by which consumers judge product performance. There is a need for improved performance on glassware.

Numerous types of nonionic surfactants useful in automatic dishwasher detergent compositions have been reported in the literature. For example, U.S. Pat. No. 3,956,401 (Scardera et al.) reports a $C_7$–$C_{10}$ alcohol alkoxylated to form a three block grouping of oxypropylene/oxyethylene/oxypropylene. U.S. Pat. No. 4,410,447 (Decker et al.) reports a low foaming surfactant using a $C_7$–$C_{11}$ primary alcohol as a hydrophobe onto which is first attached oxypropylene units followed by a random oxyethylene/oxypropylene mixture. Not only alkyl but also aromatic hydrophobes have been reported. U.S. Pat. No. 4,436,642 (Scott) discloses use of a $C_6$–$C_{12}$ alkyl substituted phenol alkoxylated first with a block of propylene oxide and then ethylene oxide. Another structural variation has been the incorporation of an end-capping unit to the alkoxylated chain. European patent application No. 0 197 434 (Pruhs et al.) describes defoaming nonionic surfactants formed from the ethoxylation of $C_8$–$C_{18}$ alcohol end-capped with $C_1$–$C_4$ alkanol, particularly n-butanol.

Most of the aforementioned defoaming surfactants have been formulated for use in powdered automatic dishwashing detergent formulations. More recently, there has been significant consumer interest in pourable liquid versions. Greater challenges are presented by liquid formulations. With powders, many techniques are available to separate surfactant from the oxidizing agent. Providing a coating over the oxidizing materials is, for instance, one method of protecting surfactant against degradation. Even without special separation techniques, powders by their very nature diminish the interaction between components. On the other hand, liquid formulations require their constituents, including any defoaming surfactants to be more oxidatively stable than would ordinarily be necessary in a powder.

Accordingly, it is an object of the present invention to provide novel nonionic surfactants which are highly efficient defoamers.

Another object of the present invention is to provide novel nonionic surfactants which display improved oxidative stability.

A further object of the present invention is to identify novel nonionic surfactants that not only defoam but have improved effectiveness against spotting and filming problems associated with the cleaning of glassware.

Another object of this invention is to provide an automatic dishwashing detergent composition utilizing the novel nonionic surfactants.

A more particular object of the present invention is to provide a defoaming nonionic surfactant whose oxidative stability is sufficient for incorporation into liquid formulations containing hypochlorite generating oxidizing agents.

SUMMARY OF THE INVENTION

Detergent compositions are disclosed comprising:

(i) from about 0.1 to about 15% of a nonionic surfactant identified by formula I

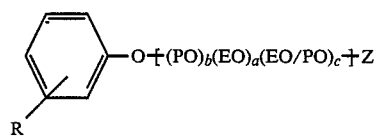

I wherein

R is an alkyl group containing from 3 to about 16 carbon atoms;

EO and PO represent oxyethylene and oxypropylene groups, respectively;

a, b and c may each range from 0 to about 20, with the sum of a, b and c being at least about 2;

the ratio of EO to PO is at least 1 but no higher than about 10; and

Z is selected from methyl or chloroethyl groups and said group is attached to an oxyethylene unit at an oxygen atom thereof;

(ii) from about 0.5 to about 10% of an oxidizing agent selected from hypochlorite and hydrogen peroxide generating compounds; and (iii) from about 0 to about 80% of a builder.

The invention also reports a method of reducing foaming in the cleaning of dishes in an automatic dishwasher comprising contacting the dishes with a bleaching detergent composition containing a nonionic surfactant of formula I.

DETAILED DESCRIPTION OF THE INVENTION

A study of commercially available defoaming surfactants has revealed that certain types of structural features promote oxidative stability and improve cleaning performance. Based on this study, it was determined that the optimum alkoxylate type nonionic surfactant is one having the formula:

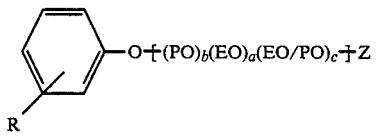

I

The R is an alkyl group containing from 3 to about 16 carbon atoms, preferably from 6 to 12, optimally between 8 and 9 carbon atoms. EO and PO stand for oxyethylene and oxypropylene groups, respectively; EO/PO stands for a random mixture of oxyethylene and oxypropylene units which may range in a ratio from about 20:1 to about 1:1. As represented in the above formula, the notation (EO) and (PO) refer to block polymer units; within the context of the formula the (EO) block may precede or follow the (PO) block depending on the particular surfactant species. Subscripts a, b and c each have a value ranging from 0 to about 20, preferably from about 2 to about 15, more preferably from about 3 to about 10. The sum of a, b and c must be at least 2 and can range up to about 20; preferably the sum of a, b and c ranges from about 4 to about 16, optimally from about 6 to about 10. Most importantly, the overall ratio of EO to PO must be at least 1, but no higher than about 10, preferably between 1 and 2, optimally about 1.5.

End-capped unit Z may either be a methyl or chloroethyl group and these groups are attached to an oxyethylene unit at an oxygen atom.

Surfactants which are particularly preferred are those having the structures II and III outlined below:

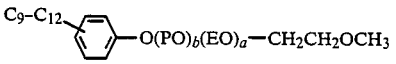

II

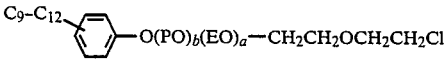

III

The surfactants of this invention may be prepared by condensing an alkyl phenol with propylene oxide and/or ethylene oxide in an amount and respective order dependent upon the particular arrangement of block and random units necessary to form the compound(s). Alkoxylation usually requires the presence of a catalyst which may be sodium or potassium hydroxide, sodium acetate, or preferably an alkali metal alkoxylate such as sodium methoxide. Any other type of catalyst commonly used for alkylene oxide addition reactions with reactive hydrogen compounds may also be employed. These reactions are preferably conducted at elevated temperatures. Upon completion of the alkoxylation, the catalyst may be removed from the reaction mixture by neutralization, filtration or ion exchange.

Methyl groups can be introduced as the end-cap through a method involving reaction between chloromethane and an oxyethylene end unit of a surfactant under conditions of elevated temperature and catalysis. Chloroethyl end-cap groups may be introduced by reaction of an oxyethylene end unit with thionyl chloride.

Surfactants of the present invention should desirably have a cloud point below 40° C., preferably less than 20° C., optimally less than about 15° C. Cloud point is defined as the temperature at which clarity of a liquid composition is lost as the external temperature is lowered. Lower cloud points are indicative of improved defoaming properties.

Although the surfactants of the present invention can be used in a wide variety of cleaning products, they have been especially designed for use in automatic dishwasher detergents. Within the autodish category, these surfactants exhibit properties rendering them uniquely suited for the aqueous thixotropic (liquid) form of automatic dishwasher product. The general formulation parameters are set forth in the Table below.

TABLE I

Automatic Dishwasher Detergent Formulations

| | Powder (wt. %) | | Liquid (wt. %) | |
|---|---|---|---|---|
| Component | General Range | Preferred Range | General Range | Preferred Range |
| Nonionic Surfactant | 0.1–10 | 0.2–2.0 | 0.1–10 | 0.2–2.0 |
| Builder | 5–80 | 15–65 | 5–60 | 15–40 |
| Sodium Silicate | 1–20 | 2–15 | 1–20 | 1–20 |
| Filler | 0–60 | 8–20 | — | — |
| Bleaching Agent | 0.1–20 | 0.5–10 | 0.1–20 | 0.5–10 |
| Thixotropic Thickener | — | — | 0.5–15 | 1–5 |
| Water | till 100 | till 100 | till 100 | til 100 |

Builder Materials

The dishwashing detergent compositions of this invention can contain all manner of builders commonly taught for use in automatic dishwashing compositions. The builders can include any of the conventional inorganic and organic water-soluble builder salts.

Typical of the well known inorganic builders are the sodium and potassium salts of the following: pyrophosphate, tripolyphosphate, orthophosphate, carbonate, bicarbonate, sesquicarbonate and borate.

Particularly preferred builders can be selected from the group consisting of sodium tripolyphosphate, sodium carbonate, sodium bicarbonate and mixtures thereof. When present in these compositions, sodium tripolyphosphate concentrations will range from about 10% to about 40%, preferably from about 15% to about 40%. Sodium carbonate and bicarbonate when present can range from about 10% to about 50%; preferably from about 20% to about 40%.

Organic detergent builders can also be used in the present invention. They are generally sodium and potassium salts of the following: citrate, nitrilotriacetates, polyacrylates, polyphosphonates, oxydisuccinates, oxydiacetates, carboxymethyloxy succinates, tetracarboxylates, starch and oxidized heteropolymeric polysaccharides. When present, organic builders are preferably present from about 1% to about 35% of the total weight of the detergent composition.

The foregoing detergent builders are meant to illustrate but not limit the types of builder that can be employed in the present invention.

Silicate

The dishwashing detergent compositions of this invention contain sodium or potassium silicate. This material is employed as a cleaning ingredient, source of alkalinity, metal corrosion inhibitor and protector of glaze on china tableware. Especially effective is sodium silicate having a ratio of $SiO_2$:$Na_2O$ of from about 1.0 to about 3.3, preferably from about 2 to about 3.2. Some of the silicate may be in solid form.

Oxidizing Agent

A wide variety of oxidizing agents may be employed for use with the dishwashing compositions. Both halogen and peroxygen type materials are encompassed by this invention.

When formulating a liquid automatic dishwashing composition, it is most preferred to employ aqueous sodium hypochlorite as the oxidizing agent. Powder formulations employ halogen donor oxidizing agents in the form of precursor compounds that generate hypochlorite upon addition of water.

Among the suitable halogen donor oxidizing agents are heterocyclic N-bromo and N-chloro imides such as trichlorocyanuric, tribromocyanuric, dibromo- and dichlorocyanuric acids, and salts thereof with water solubilizing cations such as potassium and sodium. An example of the hydrated dichlorocyanuric acid is Clearon CDB 56, a product manufactured by the Olin Corporation. These oxidants may be employed in admixtures comprising two or more distinct chlorine donors. An example of a commercial mixed system is one available from the Monsanto Chemical Company under the trademark designation "ACL-66" (ACL signifying "available chlorine" and the numerical desingation "66", indicating the parts per pound of available chlorine) which comprises a mixture of potassium dichloroisocyanurate (4 parts) and trichloroisocyanurate acid (1 part).

Other N-bromo and N-chloro imides may also be used such as N-brominated and N-chlorinated succinimide, malonimide, phthalimide and naphthalimide. Other compounds include the hydantoins, such as 1,3-dibromo and 1,3-dichloro-5,5-dimethylhydantoin; N-monochloro-C,C-dimethylhydantoin; methylene-bis(N-bromo-C,C-dimethylhydatoin); 1,3-dibromo and 1,3-dichloro 5-isobutylhydantoin; 1,3-bromo and 1,3-dichloro 5-methyl-5-ethylhydantoin; 1,3-dibromo and 1,3-dichloro, 5,5-isobutylhydantoin; 1,3-dibromo and 1,3-dichloro 5-methyl-5-n-amylhydantoin, and the like. Further useful hypohalite liberating agents comprise tribromomelamine and trichloromelamine. Dry, particulate, water-soluble anhydrous inorganic salts are likewise suitable for use herein such as lithium, sodium or calcium hypochlorite and hypobromite.

The hypohalite liberating oxidizing agent, may, if desired, be provided in a form of a stable solid complex or hydrate. Examples include sodium p-toluene-sulfobromoaminetrihydrate, sodium benzene-sulfo-chloroamine-dihydrate, calcium hypobromite tetrahydrate, calcium hypochlorite tetrahydrate, etc. Brominated and chlorinated trisodium phosphate formed by the reaction of the corresponding sodium hypohalite solution with trisodium phosphate (and water if necessary) likewise comprise efficacious materials.

Preferred chlorinating agents include potassium and sodium dichloroisocyanurate dihydrate, chlorinated trisodium phosphate and calcium hypochlorite. Preferred concentrations of all of these materials should be such that they provide about 0.2 to about 1.5% available chlorine.

Suitable chlorine-releasing agents are also disclosed in the ACS monograph entitled "Chlorine-Its Manufacture, Properties and Uses" by Sconce, published by Reinhold in 1962. This book is incorporated by reference.

Among the suitable peroxygen type oxidizing agents are the salts of persulfate, dipersulfate, percarbonate and perborate. Especially preferred are sodium perborate tetrahydrate and sodium perborate monohydrate. Organic peroxy acids such as peracetic acid or 1,12-diperoxydodecanedioic acid may also be employed. Organic peracids are, however, less preferred because of their greater cost.

Filler

An inert particulate filler material which is water-soluble may also be present. This material should not precipitate calcium or magnesium ions at the filler use level. Suitable for this purpose are organic or inorganic compounds. Organic fillers include sucrose, sucrose esters and urea. Representative inorganic fillers include sodium sulfate, sodium chloride and potassium chloride. A preferred filler is sodium sulfate. Its concentration may range from 0% to 60%, preferably about 10% to 20%.

Minor accounts of various other adjuvants may be present in the detergent powder. These include perfumes, flow control agents, foam depressants, soil supending agents, antiredeposition agents, anti-tarnish agents, enzymes and other functional additives.

Thixotropic Thickeners

Thickeners or suspending agents must be added to the liquid versions of automatic dishwasher detergent compositions. They provide thixotropic properties to an aqueous medium. These thickeners may be organic or inorganic water-soluble, water-dispersible or colloid-forming, monomeric or polymeric, and should of course be stable to highly alkaline and oxidative environments. Those especially preferred generally comprise the inorganic, colloid-forming clays of smectite and/or attapulgite types. Smectite clays include montmorillonite (bentonite), hectorite, saponite and laponite clays. Materials of this type are available under trade names such as Thixogel No. 1 and Gelwhite GP from Georgia Kaolin Company (both being montmorillonite). Attapulgite clays include the materials commerically available under the trademark Attagel, i.e. Attagel 40, Attegel 50 and Attagel 150 from Englehardt Minerals and Chemicals Corporation. Mixtures of smectite and attapulgite clays are useful when combined in the weight ratios of 4:1 to 1:5.

Useful thickeners among the organic polymers are water-soluble polycarboxylic acids or salts. Particularly useful is sodium polyacrylate with molecular weight in the range of 1,000 to 50,000, commercially available under the trademark Acrysol and described in GB 2 164 350A (Lai et al.). Preferred amounts of the water-soluble polymeric carboxylic acid will range from about 0.01 to about 3%.

Amounts of water present in the liquid type compositions should neither be so high as to produce unduly low viscosity and fluidity, nor so low as to produce unduly high viscosity and low flowability, thixotropic properties in either case being diminished or destroyed. Water will generally be present in an amount ranging from 45 to 75 wt.%, preferably about 55 to 65 wt.%.

The following examples will more fully illustrate the embodiments of this invention. All parts, percentages and proportions referred to herein and in the appended claims are by weight unless otherwise indicated.

EXAMPLE 1

Interactions of nonionic surfactants with hypochlorite are complicated. Attack sites are the ether linkages, terminal hydroxyl group and the hydrophobic alcohol unit. Each of these structural components of typical commercially available nonionic surfactants has been investigated.

A liquid type automatic dishwashing detergent base formulation is outlined in Table I. Various commercially known defoaming surfactants (1–16) and an experimental surfactant (17), listed in Table II, were incorporated at 2 wt.% to the base liquid composition. Samples were stored in glass vials and submerged in a temperature controlled water bath. Subsequent thereto, the samples were titrated for available chlorine and the pH analyzed.

TABLE I

| Liquid type Automatic Dishwashing Detergent Base | |
|---|---|
| Component | Weight % |
| Sodium Tripolyphosphate | 16.0 |
| Sodium Carbonate | 6.0 |
| Sodium Silicate | 8.0 |
| Sodium Hydroxide | 1.2 |
| % Available Chlorine (as hypochlorite) | 1.0 |
| Bentonite clay | 4.0 |
| Attapulgite clay | 1.0 |
| Water | Balance |

TABLE II

| Surfactants Investigated | |
|---|---|
| Surfactant | Chemical Structure |
| 1 | alkanol-$(PO)_4(EO)_4(PO)_4$ |
| 2 | $[(alkyl)(SO_3Na)C_6H_3]—O—[C_6H_4(SO_3Na)]$ |
| 3 | $C_6H_5O—(EO)_{16.5}(PO)_{11}$ |
| 4 | $C_6H_5O—(EO)_{4.5}(PO)_{12}$ |
| 5 | $C_{12}$–$C_{15}$ alkanol-$(EO)_7$ |
| 6 | $C_8$ alkanol-$(EO)_5—CH_2COO^-Na^+$ |
| 7 | $C_6H_5O—(EO)_2—CH_2COO^-Na^+$ |
| 8 | $C_6H_5O—(EO)_3—CH_2COO^-Na^+$ |
| 9 | $C_6H_5O—(EO)_4—CH_2COO^-Na^+$ |
| 10 | $C_6H_5O—(EO)_6—CH_2COO^-Na^+$ |
| 11 | $(C_9$ alkyl$)C_6H_4O—(EO)_4—CH_2COO^-Na^+$ |
| 12 | $C_{12}$–$C_{14}$ alkanol-$(EO)_6$ |
| 13 | $C_{12}$–$C_{14}$ alkanol-$(EO)_6—CH_3$ |
| 14 | $C_{16}$–$C_{18}$ alkanol-$(EO)_{4.5}$ |
| 15 | $C_{16}$–$C_{18}$ alkanol-$(EO)_{4.5}—CH_3$ |
| 16 | $C_{12}$–$C_{15}$ alkanol-$(EO)_9—C(CH_3)_3$ |
| 17 | $C_6$–$C_{10}$ alkanol-$(PO)_4(EO)_4(PO)_4CH_2C_6H_5$ |

TABLE III

| | Percent Available Chlorine | | | |
|---|---|---|---|---|
| | 1 week | | 4 weeks | |
| Surfactant | 25° C. | 37° C. | 25° C. | 37° C. |
| Base alone | 1.00 | 0.95 | 1.00 | 0.87 |
| 1 | 0.60 | 0.35 | 0.29 | 0.035 |
| 2 | 0.95 | 0.52 | 0.90 | 0.67 |
| 3 | 0.65 | 0.39 | 0.45 | 0.14 |
| 4 | 0.81 | 0.53 | 0.60 | 0.25 |
| 5 | 0.54 | 0.17 | 0.14 | 0.00 |
| 6 | 0.91 | 0.69 | 0.64 | 0.19 |
| 7 | 0.74 | 0.54 | 0.61 | 0.25 |
| 8 | 0.78 | 0.48 | 0.66 | 0.32 |
| 9 | 0.98 | 0.44 | 0.80 | 0.50 |
| 10 | 0.93 | 0.46 | 0.79 | 0.48 |
| 11 | 0.92 | 0.50 | 0.81 | 0.50 |
| 12 | 0.87 | 0.45 | 0.50 | 0.15 |

TABLE III-continued

| | Percent Available Chlorine | | | |
|---|---|---|---|---|
| | 1 week | | 4 weeks | |
| Surfactant | 25° C. | 37° C. | 25° C. | 37° C. |
| 13 | 0.94 | 0.80 | 0.61 | 0.20 |
| 14 | 0.87 | 0.80 | 0.60 | 0.15 |
| 15 | 0.86 | 0.86 | 0.65 | 0.25 |
| 16 | 0.85 | 0.24 | 0.25 | 0.00 |
| 17 | 0.75 | 0.50 | 0.40 | 0.10 |

Certain conclusions can be drawn from the chlorine stability results outlined in Table III. After storage for a month, the surfactant which least interacts with chlorine, and thereby allows for a higher available chlorine content, is surfactant 2. Indeed, the surfactant is widely used commercially for defoaming autodish compositions; it is sold by Dow under the trademark Dowfax 3B-2. The aromatic structures at either end of the ether linkage undoubtedly contribute to this stability. Surfactants 9, 10 and 11 exhibit the next best stability. Performance of these materials compared favorably with that of surfactants 3 and 4 which are not end-capped with an acetate group. Comparison of stability between surfactants 1 and 17 further illustrates the effect of end-capping. Surfactant 17 is substantially identical to surfactant 1 with the exception of a benzyl end-group. From these results, it would appear that end-capping is highly beneficial for protection against oxidative degradation.

Another observation is the better performance of surfactant 4 than that of surfactant 1. Although the structures vary in several respects, it would appear that the greatest influence is that derived by the hydrophobe portion. Surfactant 1 is based on a $C_6$–$C_{10}$ alkanol while surfactant 4 is based on phenol. The phenolic hydrophobe has better stability and interferes less with the available chlorine.

Based on the foregoing results, the preferred defoaming surfactant should be a molecule with an aromatic hydrophobe and protected at its terminal hydroxyl group with an end-capping unit.

EXAMPLE 2

Not only must surfactants for automatic dishwasher compositions be chlorine stable, they must, most importantly, deliver defoaming and wetting action. Foam measurements on many of the surfactants listed in Table II were performed on 500 ml aqueous solutions containing 0.06 wt.% surfactant. The foam testing device consisted of a Waring blender surrounded by a jacketed column to maintain temperature. Foam heights were measured after 60 seconds of agitation and after 60 seconds at rest.

TABLE IV

| Surfactant Foaming Assessment | | |
|---|---|---|
| Surfactant | Initial Foam Height (mm) | Final Foam Height (mm) |
| 1 | trace | 2.5 |
| 2 | 54 | 48 |
| 3 | 5 | 15 |
| 4 | trace | trace |
| 5 | 55 | 48 |
| 6 | 7 | 10 |

The data show that surfactant 2, with its highly stable structure, unfortunately is relatively poor at defoaming. A comparison of surfactants 3 and 4 indicates that there is a significant defoaming benefit where the amount of ethylene oxide is minimized and the presence of propylene oxide maximized. A confirmatory result is seen when surfactants 1 and 5 are compared, the former having an excess of propylene oxide and the latter containing only ethylene oxide. Surfactant 1 had substantially better defoaming performance.

In the further Examples the advantages of an excess of propylene oxide are mitigated by including end-cap units necessary for increased bleach stability.

EXAMPLE 3

A number of further surfactants were evaluated to determine the optimum structural properties required for use in automatic dishwasher compposition containing chlorine. Polytergent SLF-18, a product of the Olin Corporation, was used as a reference. This material is known to be a $C_7$–$C_{10}$ alcohol alkoxylated to form a three block grouping of PO/EO/PO ending in a hydroxyl group. Test surfactants were based on structure IV outlined below:

$$(CH_3)_3CC_6H_4O—(PO)_b(EO)_a—Z \qquad \text{IV}$$

TABLE V

| Sample No. Surfactant | b,a | Z | Hydroxyl No. | Molecular Weight | HLB |
|---|---|---|---|---|---|
| 18 | 4,4 | H | 106.0 | 559 | 5.05 |
| 19 | 4,6 | H | 93.0 | 647 | 5.75 |
| 20 | 4,4 | $CH_3$ | 7.5 | 573 | 3.95 |
| 21 | 4,4 | $CH_2C_6H_5$ | 8.0 | 650 | 1.10 |
| 22 | 4,6 | $CH_2C_6H_5$ | 2.0 | 738 | 1.80 |
| SLF-18 | — | — | — | 1800 | 4.55 |

The surfactants of Table V were evaluated for a number of physical properties. Cloud point of surfactants in water and in an electrolyte solution are reported in Table VI. Cloud point values were determined by preparing solutions of 0.1 grams surfactant in 100 ml distilled water and a similar concentration in an electrolyte solution. The latter was formulated to simulate levels and types of builder salts in a typical wash liquor. The electrolyte combination of materials were used at a strength of 4 grams per 1,000 ml water at pH 10.5 and included sodium tripolyphosphate/sodium carbonate/-sodium polysilicate at a ratio of 55/33/12.

TABLE VI

| | Cloud Points (°C.) | |
|---|---|---|
| Surfactant | Distilled Water | Electrolyte Solution |
| 18 | 18 | <5 |
| 19 | 45 | <5 |
| 20 | <5 | <5 |
| 21 | <5 | <5 |
| 22 | <5 | <5 |
| SLF-18 | 19 | <5 |

As the temperature of a nonionic solution is raised the reduced hydration of the ethylene oxide groups results in the formation of two separate isotropic phases. Onset of this phenomenon is described as the cloud point. For phase theoretical considerations, this is a liquid/liquid separation with a lower critical solution temperature.

The extent of this phase behavior is a critical function of the foam volume generated or suppressed by the nonionic. Foam volumes fall drastically above the cloud point and create conditions where the capacity to limit food soil foams is greatly enhanced. Inasmuch as the wetting ability of the surfactant is a function of the concentration in the aqueous phase it is important that the cloud point not be so low as to limit this function. Consequently, there is a need to balance both of these conditions by selecting surfactants with appropriate cloud points given the operating temperatures found in most dishwashing machines.

From Table VI, it can be seen that cloud points, as measured in distilled water, are quite satisfactory for surfactants 20–22 which are end-capped with methyl and benzyl groups. On the other hand, surfactants that are not end-capped such as 18, 19 and SLF-18, provided unacceptable cloud points.

Table VII reports foam height measurements made under machine wash conditions with and without the presence of soil. The test procedure was similar to that reported in Example 2. Here however, there was also added 2.0 grams of an automatic dishwashing liquid base formulation for alkalinity purposes along with 0.02 grams of a surfactant in 500 ml tap water, which combination represents home dishwasher conditions of 40.0 grams detergent per 10 liter wash. Soil was added as 2.0 grams of a mixture of butter and dry milk. Foam heights were measured in millimeters after one minute of agitation followed by one minute of quiescence.

TABLE VII

| Foaming Assessment Under Automatic Washing Machine Conditions | | |
|---|---|---|
| | Conditions | |
| Surfactant | No Soil | Soil |
| 18 | 9 | 11 |
| 19 | 10 | 11 |
| 20 | 5 | 10 |
| 21 | 2 | 9 |
| 22 | 2 | 9 |
| SLF-18 | 0 | 5 |
| No surfactant | — | 7 |

Table VIII reports results of surface tension measurements on six surfactants in electrolyte solution. Using a Cahn electrobalance and a Wihelmy plate setup, values of surface tension as a function of concentration were measured at 45° C. Isotherms resulting therefrom were plotted as surface pressure versus log molarity. Relevant physical data were derived from these curves.

TABLE VIII

| Surface Tension Measurements | | | |
|---|---|---|---|
| Surfactant | CMC | $\pi$cmc | $\sigma$ |
| 18 | 398 | 38.00 | 90.6 |
| 19 | 562 | 38.25 | 99.1 |
| 20 | 31.6 | 36.50 | 101.1 |
| 21 | 44.7 | 29.75 | 135.9 |
| 22 | 39.8 | 30.25 | 140.4 |
| SLF-18 | 1.00 | 32.25 | 69.0 |

| PARAMETER | UNITS |
|---|---|
| CMC | $\times 10^{-6}$ M |
| $\pi$cmc | ergs/cm$^2$ |
| $\sigma$ | Å$^2$/molecule |

At very low concentration, surface pressure is negligible and increases very slowly. As concentration builds, a point is reached where pressure increases dramatically up to an inflection point known as the critical micelle concentration (CMC). Very little increase in pressure occurs thereafter. This CMC represents a range of concentration where continued adsorption of surfactants at the interface is minimal and the formation of aggregates of surfactants in the bulk liquid initiates micellization. Surfactants that generate high surface pressures are regarded as being highly effective. Regardless of the amount needed, it is the absolute value of surface tension reduction that quantifies the effectiveness of a surfactant. However, that amount needed to achieve maximum surface pressure is the CMC and it is a measure of efficiency.

With these terms defined above, it will be seen that SLF-18, the control material, is much more efficient, its CMC is at a lower concentration, than benzyl-capped derivatives.

Table IX reports hypochlorite stability values. In these evaluations, each surfactant is dispersed in a base formula of a typical automatic dishwashing liquid so that there are equimolar solutions equivalent to 2 weight % of SLF-18. Initial available chlorine level was adjusted to 1.0%. Each week, samples were taken and titrated for available chlorine including a surfactant-free case and one with SLF-18.

TABLE IX

| Percent Available Chlorine | | | | | | |
|---|---|---|---|---|---|---|
| | 25° C. Surfactant | | | | | |
| Week No. | 18 | 19 | 20 | 22 | SLF-18 | None |
| 0 | 1.000 | 1.000 | 1.000 | 1.000 | 1.000 | 1.000 |
| 1 | 0.784 | 0.818 | 0.900 | 0.753 | 0.256 | 0.986 |
| 2 | 0.661 | — | 0.884 | 0.683 | 0.154 | 0.971 |
| 4 | 0.578 | 0.554 | 0.771 | 0.572 | 0.063 | 0.941 |
| 6 | 0.456 | 0.421 | 0.628 | 0.478 | 0.024 | 0.931 |
| 8 | 0.402 | 0.367 | 0.541 | 0.417 | 0.007 | 0.889 |
| | 45° C. Surfactant | | | | | |
| Week No. | 18 | 19 | 20 | 22 | SLF-18 | None |
| 0 | 1.000 | 1.000 | 1.000 | 1.000 | 1.000 | 1.000 |
| 1 | 0.480 | 0.425 | 0.667 | 0.535 | 0.027 | 0.865 |
| 2 | 0.277 | 0.237 | 0.466 | 0.275 | 0.000 | 0.767 |
| 4 | 0.060 | 0.049 | 0.151 | 0.083 | 0.000 | 0.635 |
| 6 | 0.050 | 0.037 | 0.113 | 0.057 | 0.000 | 0.468 |
| 8 | 0.002 | 0.019 | 0.043 | 0.017 | 0.000 | 0.387 |

Hypochlorite stability test results of Table IX show that the methyl end-cap material (20) has the greatest stability. Use of a benzylic end-cap does not result in optimum surface properties. Without end-capping, as seen with SLF-18, stability is severely sacrificed since the ether linkages are now subject to oxidation.

EXAMPLE 4

The experiments that follow detail work on surfactants similar to that reported on in Example 3 but now replacing the tert-butyl with a nonyl group on the phenol portion.

Table X outlines the nonyl phenol derivatives whose structure V is set forth below:

$$\text{nonyl—}C_6H_4O\text{—}(PO)_b(EO)_a\text{—}Z \qquad V$$

TABLE X

| Sample No. Surfactant | b,a | Z | Molecular Weight |
|---|---|---|---|
| 23 | 4,4 | H | 628 |
| 24 | 4,6 | H | 716 |
| 25 | 4,8 | H | 804 |
| 26 | 0,6 | H | 484 |
| 27 | 4,4 | $CH_3$ | 642 |
| 28 | 4,6 | $CH_3$ | 730 |
| 29 | 4,8 | $CH_3$ | 818 |
| 30 | 0,6 | $CH_3$ | 498 |
| SLF-18 | — | H | 1800 |

The surfactants of Table X were evaluated for a number of physical properties. Cloud points of these materials are listed in Table XI.

TABLE XI

| Surfactant | Cloud Points (°C.) Distilled Water | Electrolyte Solution |
|---|---|---|
| 23 | <0 | <0 |
| 24 | 28 | 25 |
| 25 | 43 | 38 |
| 26 | <0 | <0 |
| 27 | 35 | 30 |
| 28 | 37 | 31 |
| 29 | 46 | 40 |
| 30 | <0 | <0 |
| SLF-18 | 19 | <0 |

Table XII reports foam height measurements made under machine wash conditions with and without the presence of soil. The test procedure was similar to that reported in Example 3. Although the foam measurement is more qualitative than quantative, it is useful in discriminating among various materials. In this case, SLF-18 appears best in foam suppression. However, all of the samples in the Table are much better than typical anionic defoamers such as Dowfax 2A1 with foam heights of 25 to 30.

TABLE XII

| Foaming Assessment Under Automatic Washing Machine Conditions | | |
|---|---|---|
| | Conditions | |
| Surfactant | No Soil | Soil |
| 23 | 3.5 | 8.5 |
| 24 | 4.0 | 9.0 |
| 25 | 5.5 | 9.0 |
| 26 | 3.5 | 9.5 |
| 27 | 3.0 | 8.0 |
| 28 | 4.0 | 8.5 |
| 29 | 6.5 | 8.0 |
| 30 | 4.5 | 7.5 |
| SLF-18 | 0.0 | 4.0 |
| No surfactant | 0.0 | 7.0 |

Table XIII reports results of surface tension measurements on the nonyl phenol derivatives. Values reported in this Table were obtained by the method already outlined in Example 3.

TABLE XIII

| Surface Tension Measurements | | | |
|---|---|---|---|
| Surfactant | CMC | $\pi$cmc | $\sigma$ |
| 23 | 1.58 | 32.25 | 48.98 |
| 24 | 1.78 | 32.00 | 52.93 |
| 25 | 3.55 | 31.50 | 56.13 |
| 26 | 14.1 | 36.75 | 53.65 |
| 27 | 2.11 | 34.00 | 34.20 |
| 28 | 2.51 | 34.00 | 47.58 |
| 29 | 2.82 | 33.25 | 55.50 |
| 30 | 18.8 | 39.50 | 51.20 |
| SLF-18 | 1.00 | 32.25 | 69.0 |

| PARAMETER UNITS | |
|---|---|
| CMC | $\times 10^6$ M |
| $\pi$cmc | ergs/cm$^2$ |
| $\sigma$ | Å$^2$/molecule |

A discussion of surface tension measurements and their significance has previously been presented under Example 3 and is not here repeated. From that discussion, it is to be understood that the larger the CMC value, the more efficient is the surfactant. From Table XIII it is evident that several of the sample surfactants of this invention come very close in CMC value to SLF-18. Samples 23–25 and 27–29 all had CMC values very close to that of SLF-18. These were all considerably better than the CMC values of the tert-butyl phenol derivatives listed in Table VIII. Further, it is noted that samples 26 and 30 which were wholly ethoxylated and contained no proproxylation had significantly poorer CMC values. Thus, it is evident that there must be an upper limit to ethoxylation; some propylene oxide must be present within the molecule.

The foregoing description and Examples illustrate selected embodiments of the present invention. In light thereof, variations and modifications will be suggested to one skilled in the art, all of which are within the spirit and purview of this invention.

What is claimed is:

1. Detergent compositions comprising:

(i) from about 0.1 to about 15% of a nonionic surfactant identified by formula I:

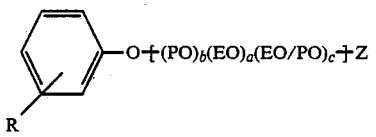

I wherein

R is an alkyl group containing from 8 to about 12 carbon atoms;

EO and PO represent oxyethylene and oxypropylene groups, respectively;

a, b and c may each range from 0 to about 10, with the sum of a, b and c ranging from about 6 to about 12;

the ratio of EO to PO is at least 1 but no higher than about 2; and

Z is selected from methyl or chloroethyl groups and said group is attached to an oxyethylene unit at an oxygen atom thereof;

(ii) from about 0.5 to about 10% of an oxidizing agent selected from hypochlorite and hydrogen peroxide generating compounds; and (iii) from about 0 to about 80% of a builder.

2. A composition according to claim 1 wherein R is a $C_8$ or $C_9$ alkyl radical.

3. A composition according to claim 1 wherein Z is a methyl group.

4. A composition according to claim 1 wherein Z is a chloroethyl group.

5. A composition according to claim 1 wherein R is a $C_9$ alkyl radical.

6. A composition according to claim 1 wherein R is a $C_8$ or $C_9$ alkyl radical, Z is a methyl and the ratio of EO to PO ranges between 1 and 2.

7. A composition according to claim 1 further comprising from about 1 to about 20% of sodium silicate.

8. A composition according to claim 1 wherein the oxidizing agent is a chlorine releasing compound selected from the group consisting of sodium hypochlorite, sodium dichloroisocyanurate dihydrate, potassium dichloroisocyanurate dihydrate, and mixtures thereof.

9. A composition according to claim 1 wherein the oxidizing agent is a hydrogen peroxide releasing compound selected from the group consisting of dipersulfate, persulfate, percarbonate and perborate salts.

10. A composition according to claim 9 wherein the perborate is sodium perborate tetrahydrate or sodium perborate monohydrate.

11. A composition according to claim 1 further comprising a thixotropic thickener.

12. A composition according to claim 11 wherein said thickener is a clay selected from smectite or attapulgite type clays.

13. A composition according to claim 11 wherein said thickener is a bentonite clay.

14. A composition according to claim 11 wherein the thickener is a water-soluble polymeric carboxylic acid or salt thereof.

15. A composition according to claim 14 wherein said polymer is sodium polyacrylate.

16. A composition according to claim 1 which is in granular form.

17. A composition according to claim 1 which is in a liquid form.

18. A composition according to claim 6 wherein the ratio of EO to PO ranges between 1 and 1.5.

* * * * *